United States Patent [19]

Atterby et al.

[11] Patent Number: 4,802,421

[45] Date of Patent: Feb. 7, 1989

[54] PALLET CONSISTING OF TWO OR SEVERAL BASE MEMBERS

[76] Inventors: Fred Atterby, Revviken, S-181 90 Lidingö ; Bertil Voss-Schrader, Korshamnsviken, S-139 00 Värdmö ; Lennart Tenggvist, Karlavägen 85, S-114 59 Stockholm, all of Sweden

[21] Appl. No.: 93,498

[22] PCT Filed: Dec. 8, 1986

[86] PCT No.: PCT/SE86/00556

§ 371 Date: Aug. 12, 1987

§ 102(e) Date: Aug. 12, 1987

[87] PCT Pub. No.: WO87/03859

PCT Pub. Date: Jul. 2, 1987

[30] Foreign Application Priority Data

Dec. 19, 1985 [SE] Sweden ..... 8506025

[51] Int. Cl.[4] ..... B65D 19/20

[52] U.S. Cl. ..... 108/51.1; 108/51.3; 108/56.1

[58] Field of Search ..... 108/51.3, 56.3, 901, 108/64, 56.1, 51.1, 54.1

[56] References Cited

U.S. PATENT DOCUMENTS

| | | | |
|---|---|---|---|
| 2,479,728 | 8/1949 | Darling | 108/51.3 |
| 2,576,715 | 11/1951 | Farrell | 108/51.3 |
| 2,609,136 | 9/1952 | Sider | 108/51.3 X |
| 2,728,545 | 12/1955 | Hermitage | 108/56.3 X |
| 2,783,011 | 2/1957 | Alexander | 108/51.3 |
| 2,798,685 | 7/1957 | Mooney | 108/51.3 |
| 3,000,603 | 9/1961 | Hemann | 108/51.3 |
| 3,256,839 | 6/1966 | Peterson et al. | 108/56.1 |
| 3,434,435 | 3/1969 | Achermann et al. | 108/51.3 |
| 3,683,822 | 8/1972 | Roberts et al. | 108/56.1 X |
| 3,881,429 | 5/1975 | Seymore | 108/56.3 X |

OTHER PUBLICATIONS

WO 81/02283—International Publication of PCT/US80/01768, Parent Case U.S. Ser. No. 119,827, filed Feb. 8, 1980.

Intl. Publ. Date: Aug. 20, 1981—Inventor: L. E. Tisdale.

(Cited in PCT International Search Report).

*Primary Examiner*—Peter A. Aschenbrenner

*Attorney, Agent, or Firm*—Nies, Webner, Kurz & Bergert

[57] ABSTRACT

Pallet consisting of several base members, which can have recesses for forks of a fork lift. The base members have holes perpendicular to the length of the members distributed along and closely adjacent the upper surfaces of the base members. Tubes inserted through the holes unite the base members to form the pallet. The base members consisting of three pressed carton pieces folded to a rectangular U-section, the length of each piece corresponding to the length of the base member. The first and the second pieces have a height substantially the height of the pallet. The third piece has an inner height dimension which is approximately the diameter of the tubes. The first carton piece in a base member has the U-section upright with the back of the U downwards, the second carton piece has the U-section as an inverted U-form disposed in the first carton piece. The third carton piece is located with its U-section upright and within and uppermost in the second carton piece. The distances between the vertical walls of the carton piece U-sections are dimensioned to fit closely to and in contact with each other, being tightly fixed by gluing. The holes for the tubes are located so the tubes lead through the space enclosed by the third carton piece uppermost in the base member. The said second carton piece can alternatively be the outer-most piece relative to the first and the third carton pieces.

17 Claims, 8 Drawing Sheets

9a
9b

8

PALLET CONSISTING OF TWO OR SEVERAL BASE MEMBERS

BACKGROUND OF THE INVENTION

The present invention relates to pallets consisting of two or several base members provided with a number of holes adjacent or at a minor distance from, the upper load-bearing horizontal surface of the base members, through which holes tubes are inserted under friction to unite the base members and form the pallet. The tubes do not require a special structure to fix them to the base members being kept in position due to friction and the so-called drawer effect; the friction is considerably increased under load.

The base members of the type to which the invention pertains can, however, also be combined with each other by attaching a plate of a suitable material (board, plywood etc.) by, e.g., gluing the same to the upper horizontal surfaces of the base members, in which case the aforedescribed holes are not required or utilized. The plate then forms the load-bearing plane. When tubes are used for combining the base members the load-bearing parts of the pallet are the upper parts of the tubes and the upper surfaces of the base members in combination. If desired or required in view of the goods to be carried a pallet with tubes may be provided with one or more plates either located above the base members or between the same, which form a smooth and continuous load-bearing plane.

SUMMARY OF THE INVENTION

A pallet of the type discussed above is described in WO No. 86/01786 . . . (PCT/SE85/00346) which is incorporated herewith as a reference. The PCT patent application aims at achieving a pallet which can be handled by forks from all four sides, consisting of at least two base members provided with holes at the upper load-bearing surfaces and with recesses in the lower parts, intended to receive the forks of a conventional fork-lift truck, which pallet has a very low weight, is cheap, has a great flexibility as regards adaptability for different purposes, is not bulky when stored (since it can be stored in a non-completed state in the form of its separate parts) and which, if desired, can easily be destroyed after use by burning without formation of toxic or otherwise disturbing gases. This pallet can be handled by a fork-lift truck from all of the four sides; the forks can be inserted below the tubes from two sides and into the recesses in the base members from the remaining two sides, which is desirable for rational handling and storage of goods.

The base members for the pallets according to the present invention, are, in comparison with many previously known base members, very cheap when manufactured in bulk and have a very low eight and a fully sufficient load-bearing capacity and fulfils commercial requirements.

The specific base member for a pallet according to the present invention is characterized in that it is constituted by three pressed and folded carton pieces U-shaped cross section and with a length corresponding to the desired length of the base member, of which the first and the second pieces have a height corresponding to the height of the base member, and the third pieces has an inner height approximately equal to the diameter of the tubes which project laterally through the base members. The first carton piece is located in the base member in the upright U-section with the back or cross part of the U-section at the bottom, i.e., disposed against the floor. The second carton piece is located with the U-section inverted and inside the first carton piece; and the third carton piece is located with the U-section upright and within and uppermost in the second carton piece. The distances between the vertical walls of the U-section, rectangular, folded carton pieces being such that they fit closely to each other and by gluing are tightly fixed to each other at the surfaces in contact with each other. The holes for the base member joining tubes are made through the space defined by the third carton piece uppermost in the base member so that the tubes are supported between and by by the horizontal inner surface of the third carton piece and the horizontal inner surface of the second carton piece alternatively, the second carton piece can be the outermost one.

The invention is further elucidated in connection with a preferred embodiment having recesses for forks and with reference to the accompanying drawings, wherein:

FIG. 1 in perspective shows a pallet comprising base members according to the invention, consisting of three base members and seven tubes;

FIG. 2 in perspective shows the same pallet as FIG. 1 with one base member in a partly cut-away condition;

FIG. 3 in perspective shows a section through a base member beside a recess for forks;

FIG. 4 in perspective shows a section through a base member at a recess for forks;

Figure 9:
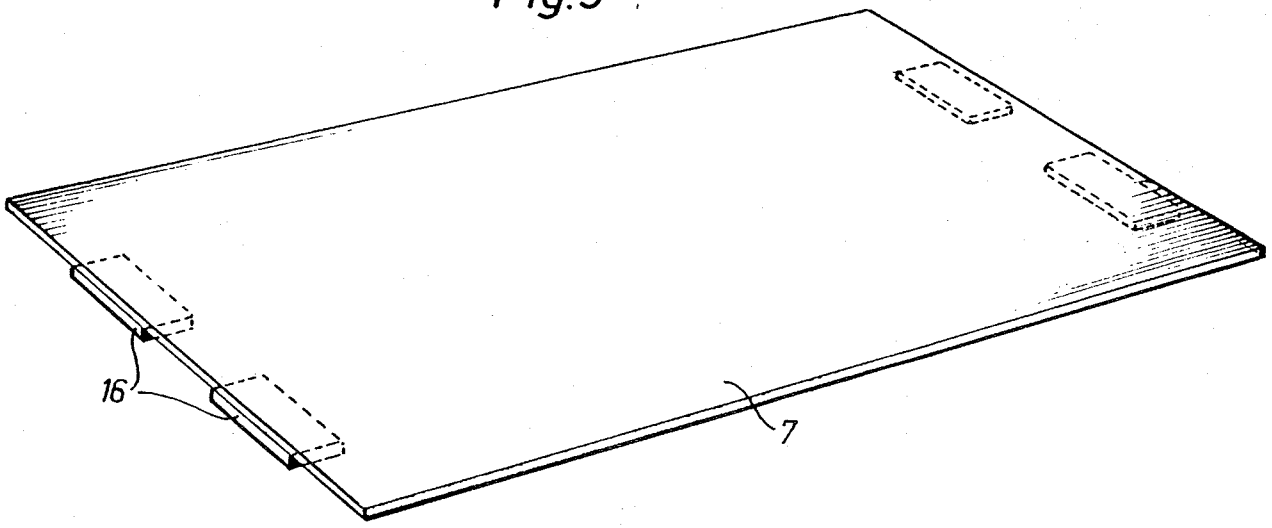
Figures 10A, 10B, 10C, 10D, 10E:
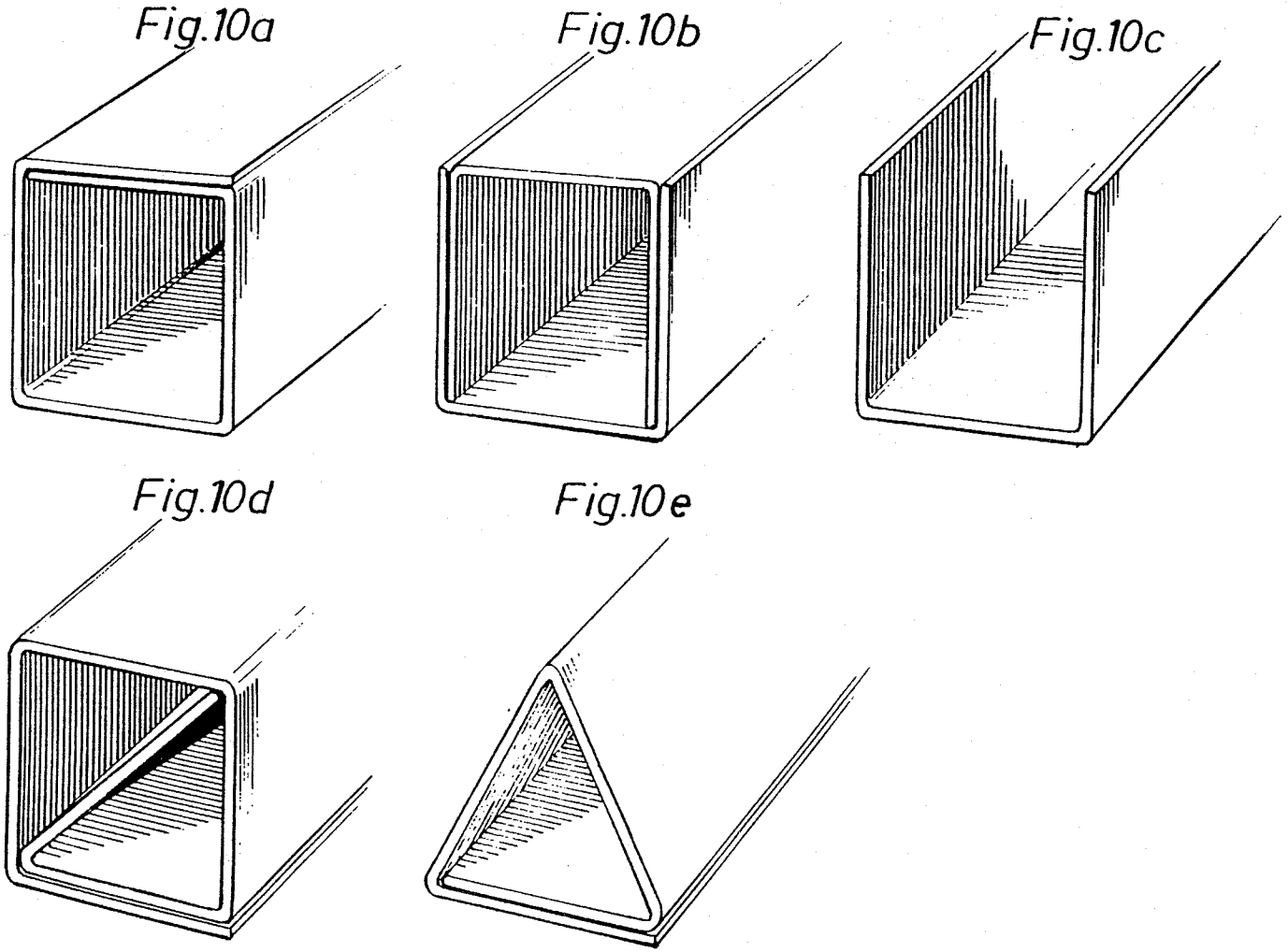
Figure 11:
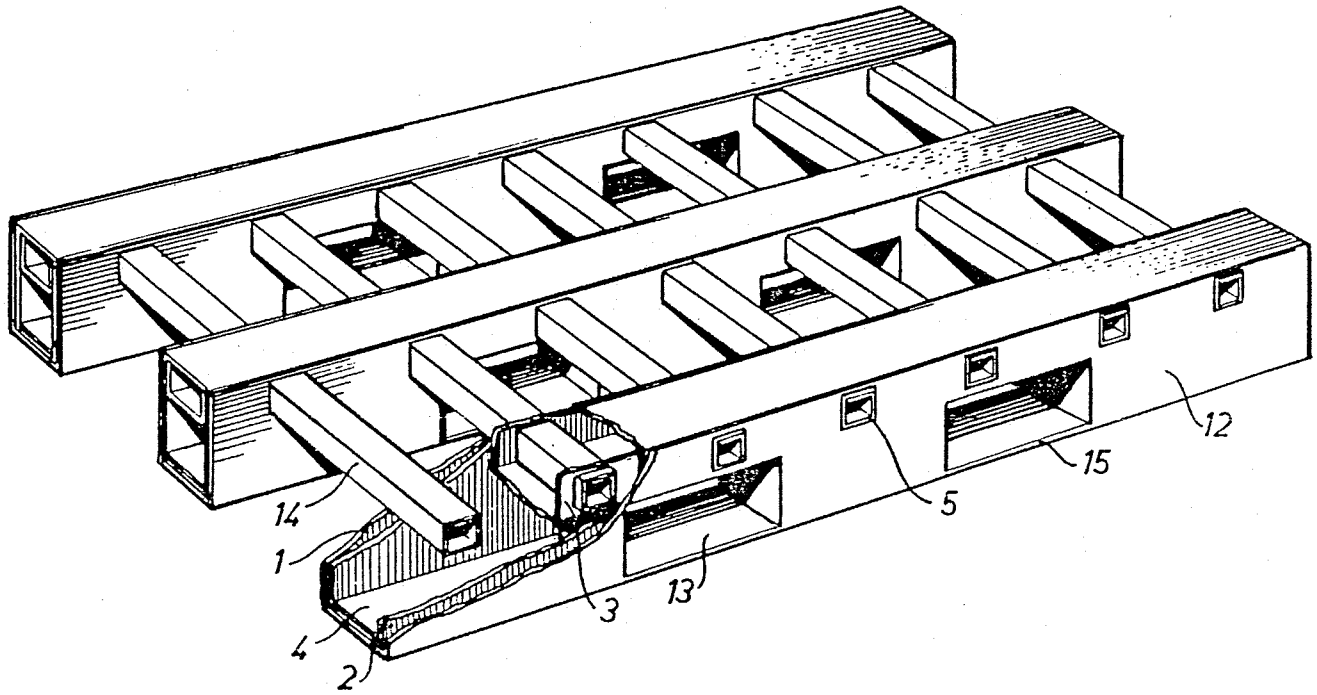

FIG. 9 in perspective shows a plate for the formation of a flat continous loading surface on the pallet;

FIG. 10*a–e* show sections of alternative embodiments of the tubes which combine the base members of the finished pallet according to the invention; and FIG. 11 in perspective shows a complete pallet provided with tubes according to FIG. 10*a*.

The base members for the pallet according to the invention are manufactured from one or several web materials, preferably a fiber-based material such as carton. The invention is elucidated below with reference to a preferred web material, viz. polyethylene-coated carton with a thickness of about 0.3–0.4 mms. but is in no way restricted thereto; alternative web materials are obvious to the expert, e.g. solid board or folding board. Such materials should have a suitable stability and strength and be submittable to pressing, folding and gluing. The material should preferably have at least a certain degree of wet strength.

Several layers of the above-mentioned polyethylene-coated carton are glued to each other to form a composite laminate material. One may use 2–8 carton layers with intermediate glue layers, preferably 3–5 carton layers. This composite material has a great stability but can in spite of that be pressed and folded. In certain cases it is preferred that the different layers in the laminate are pressed separately and coated with glue as required, whereupon the composite material at an increased temperature, at which the glue or gluing substance does not adhere, is folded to the intended form, whereupon the temperature is decreased for gluing the layers together. This procedure is especially advantageous when a great number of layers are used in the laminate. The number of layers in the laminate should, of course, be adapted to the mechanical stresses for which the finished base member is submitted.

Suitable glue products, which admit a rapid gluing, are commercially available. Thermoplastic glues may be used, e.g. in the emulsion form, optionally strengthened with a chelate-former, or glues of the hot-melt type.

As mentioned above, the base members for the pallets according to the invention comprise three carton pieces 1–3 folded to what is called a rectangular U-form, the length of which is equal to the intended length of the base member. A carton laminate is preferably used from which the pieces are pressed in a conventional manner. The design of the same is obvious in view of the drawings. The constructive features of the base member is clearly shown in FIGS. 3 and 4.

More specifically, the base members comprise a first outwardly located carton piece 1 (or carton laminate piece) which has been folded to the rectangular U-form and rests with the U-shaped section upright and with the cross piece of the U-shaped section against the floor. Inside the first piece 1, a second piece 2 is located which likewise has been folded to the rectangular U-form and is positioned with the U-shaped section inverted and inside the first piece 1. A third carton piece 3 disposed in the upright U-shaped manner is located within the second piece 2, uppermost therein, to form a space with an inner height substantially equal to the diameter or vertical dimension of a cross-section of the tubes which unite the base members in the pallet. The three carton pieces shall carefully fit to each other and all contact surfaces are glued to each other.

The holes 5 for the tubes 14 can be made in different manners. Thus, the holes can be pressed simultaneously with the pieces. Alternatively, they can be pressed or cut with a circle saw or a cutting knife. Cutting with a high pressure water jet can also be used.

When desired that the base member be provided with recesses 13 for forks, the carton pieces 1 and 2 are designed accordingly as is obvious from the drawings and, specifically, so that the piece 1 is provided with overlapping glue tongues 1*a* and 1*b* which after gluing to each other form a bonding member 15 below the recesses 13. It is preferred to strengthen the base member by gluing a stiff and strong band 4 (a strip of carton laminate) along the whole of its lower inner horizontal surface, which band is embraced by the gluing tongues 1*a* and 1*b*.

In a corresponding manner the piece 2 is provided with overlapping gluing tongues 2*a* and 2*b* which, after being glued to each other, form the upper horizontal surface in the recess 13 for the forks. In this manner this part of the base member is strengthened which is of importance since the parts in question will take the full weight of the load when the finished pallet is handled by forks.

So as to give the base member an increased diagonal stiffness it is preferred to insert in the ends of the base member suitable supports, e.g. in the form of a cylindrical body 10 made from a suitable material, such as a bobin piece with dimensions adapted to the space in question. Cross supports 11 may also be used, which can be made from the same carton laminate as used for the base member. Such supports do not need to be attached to the base member, they can quite simply be inserted under friction.

An alternative is to give the base member the required diagonal stiffness by using gluing tongues which continue from pieces 1 and/or 2. Such gluing tongues can be simple ones 8 or double 9*a* and 9*b*. A simple gluing tongue is glued inside the base member, whreas the double tongues are glued to each other.

Figure 1:
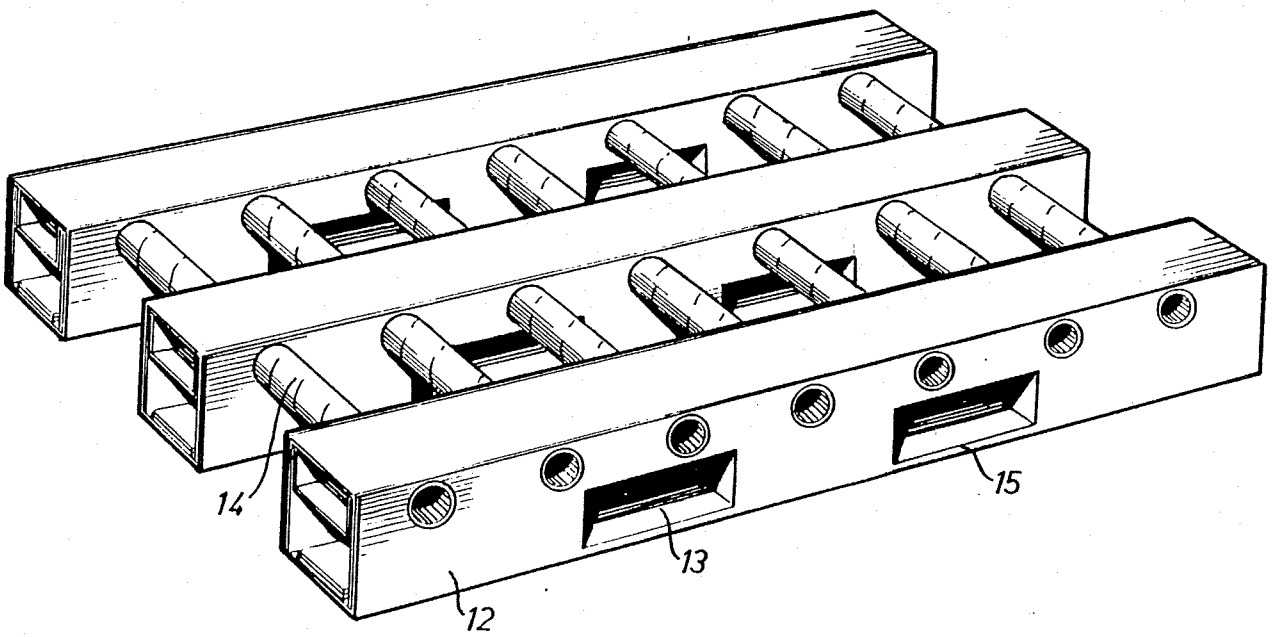
Figure 2:
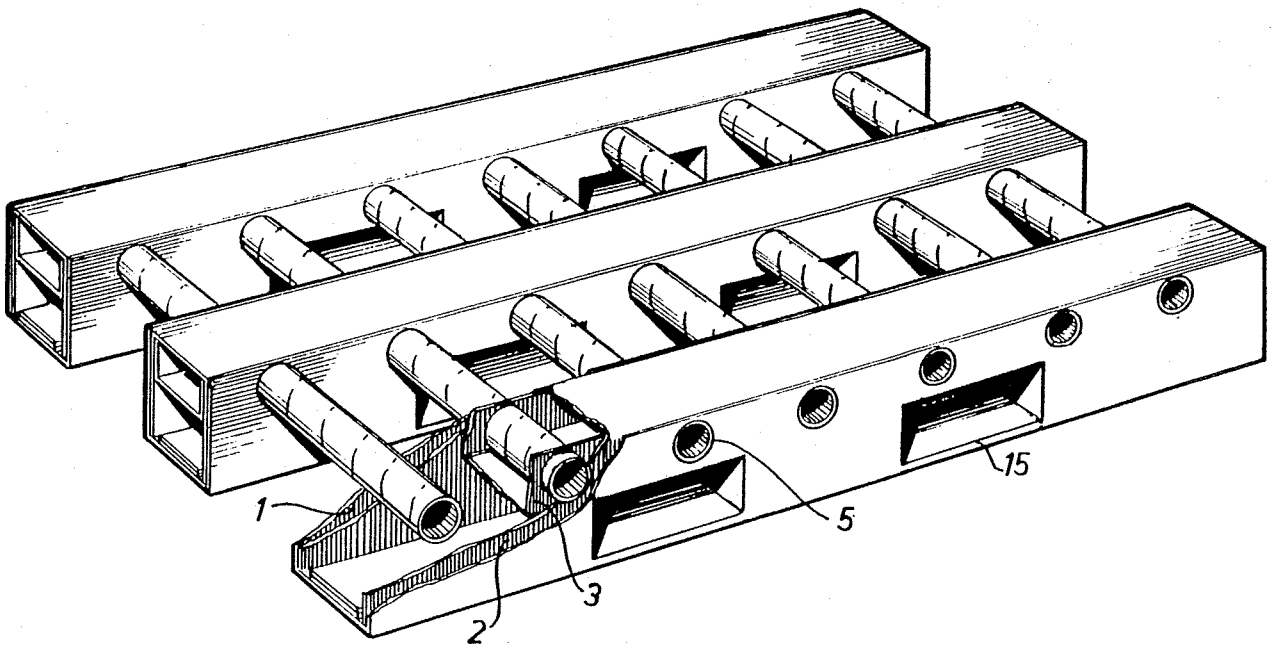
Figure 4:
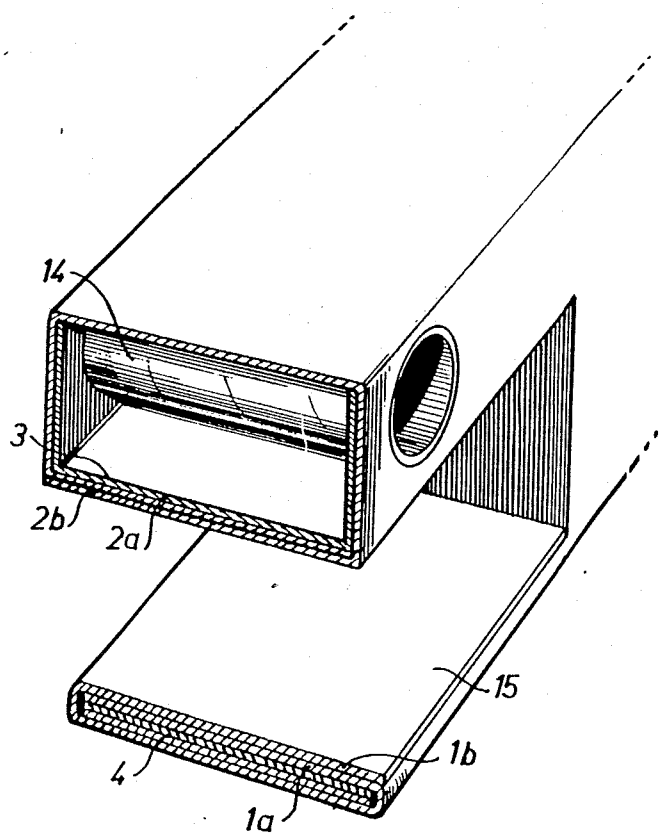
Figure 3:
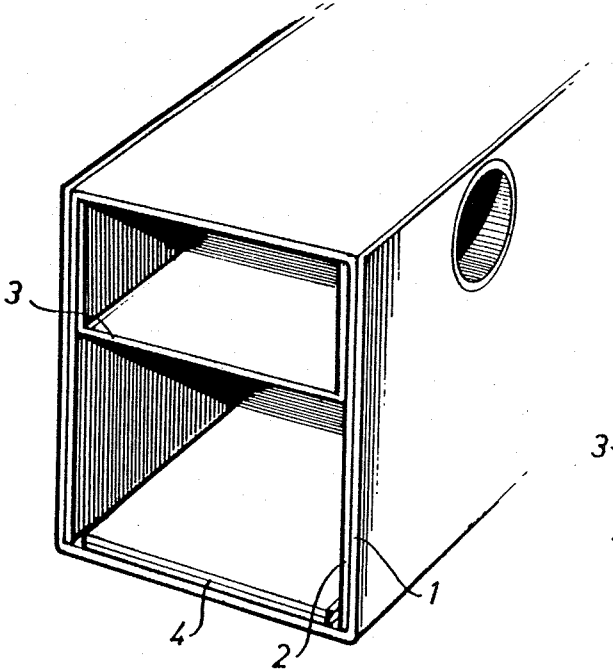
Figure 6:
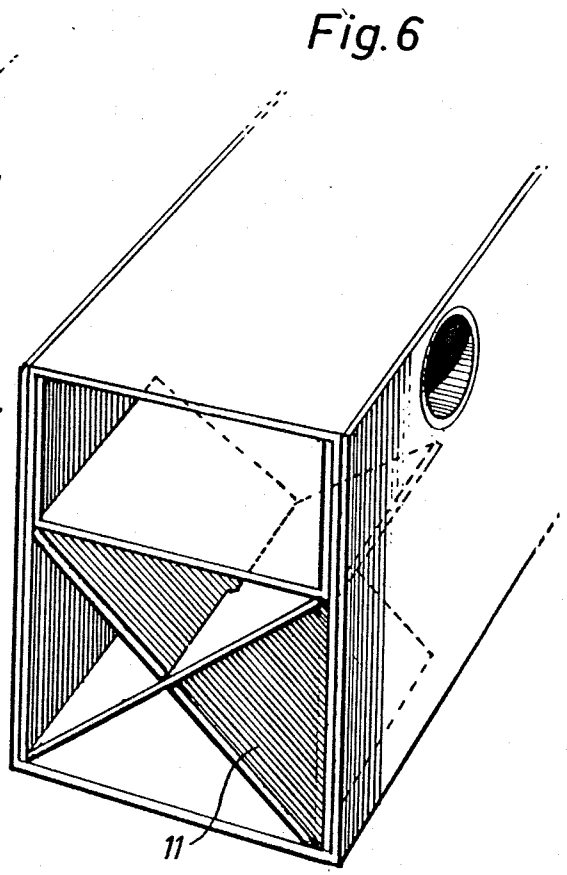
FIG. 6 is an end view in perspective of a base member with another inserted supporting body.
Figure 5:
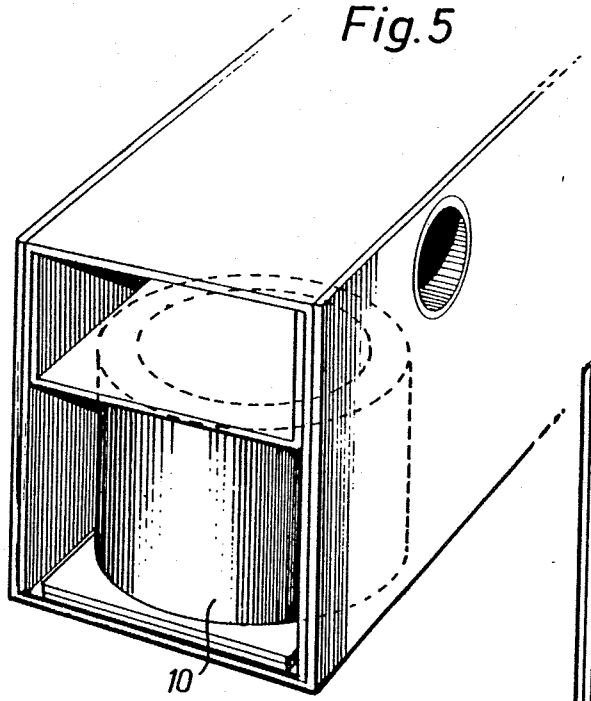
FIG. 5 is an end view in perspective of a base member with an inserted support consisting of a cylindrical body.
Figures 7, 8:
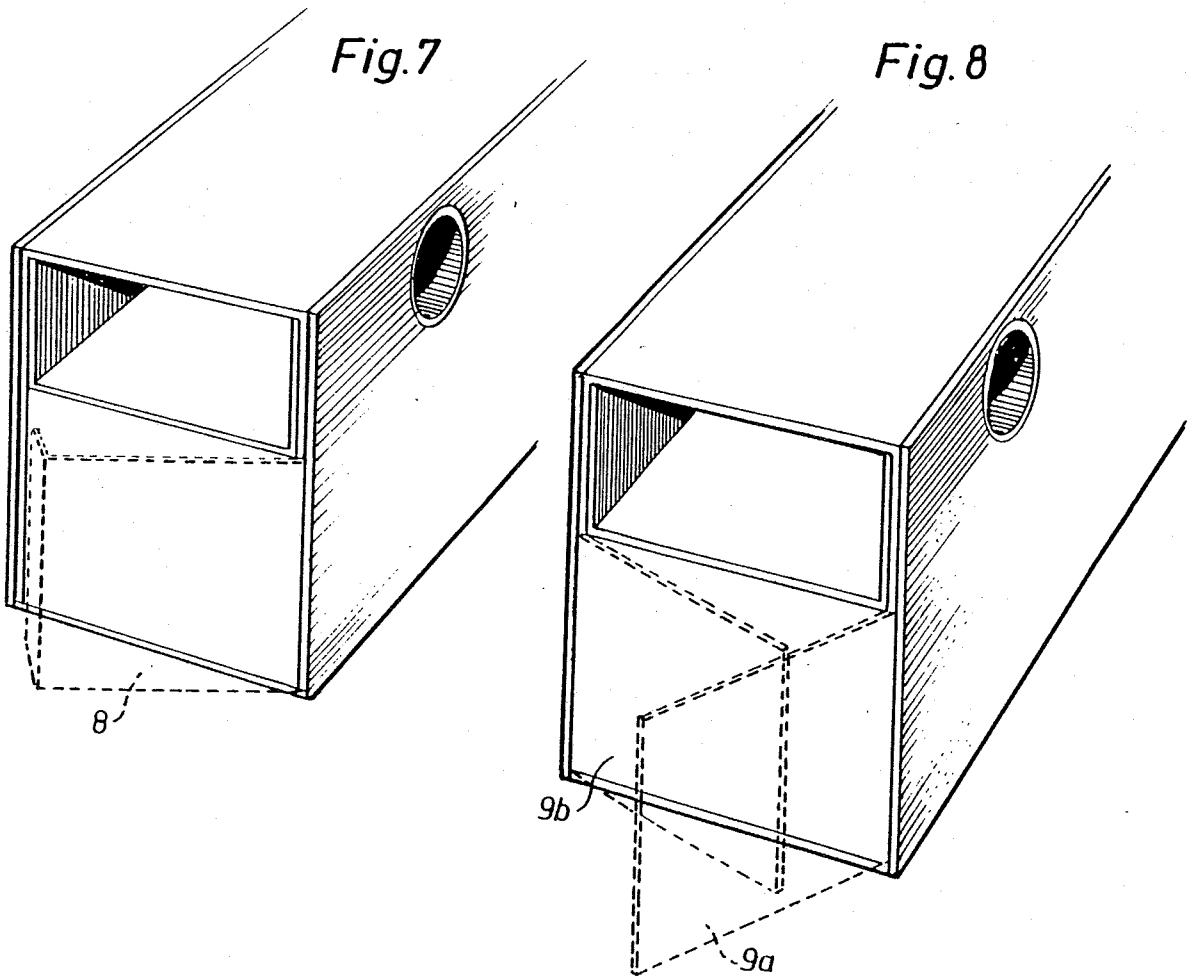
FIG. 7 is an end view in perspective of a base member with an indicated, single angled gluing tongue for closing the lower end surface of the base member.
FIG. 8 is an end view in perspective of a base member with two indicated gluing tongues which after being glued overlap each other, for closing the lower end surface of the base member.

In view of the explanations above and the drawings, especially FIGS. 3 and 4, it is obvious that the pieces 1 and 2 can switch places without any loss of strength.

For manufacturing-technical reasons as well as economical it is preferred to prepare the connecting tubes from the laminate described above for the base members. In FIG. 10 different alternatives for the cross section of such tubes are shown. The tubes are folded as shown in the drawings with gluing surfaces to the formation of tubes with an essentially rectangular form. FIG. 10*c*, however, shows an open U-section, which may be sufficient for pallets intended for easy loads. FIG. 10*e* shows a tube with a triangular cross-section. FIG. 10*d* shows in section a tube, the bending strength of which has been increased by a diagonally located integral laminate portion. For these tubes a laminate comprising 8–12 carton layers are preferably used, glued to each other with a glue of the type mentioned above. In the pallet the tubes may be located in the position shown in FIG. 10, but they may also be in positions turned e.g. 90° from the one shown.

It is, of course, also possible to use conventional round tubes of any kind of material for connecting the base members with each other.

So as to provide the pallet comprising base members and tubes according to the invention with a plane loading surface it may in some cases be suitable to cover the loading surface with a plane 7 provided with guides 16, the width of which corresponds with the distance between the base members. Alternatively, planes solely between the base members can be used.

A preferred carton material for the laminate for the base members according to the invention is the hydrofobic polyethylene-laminated carton with the thickness defined above. Pallets are often used out of doors under moist conditions. The preferred polyethylene-coated carton material is not per se water-absorbing due to the outermost located polyethylene layer. A certain slow absorption of water occurs at the edges of the material. This can however, be prevented by application of a moisture barrier on these edges. As the moisture barrier numerous different materials known per se can be used, such as fats, waxes, suitably in the molten state so as to avoid the use of toxic solvents. It is preferred to use the glues defined above for the laminate for this purpose.

The lower surfaces of the base members which are in contact with the ground can, so as to strengthen the existing thin water-repelling poly-ethylene layer, be provided with a wear-resistant surface coating, if so required. Such a coating can be made with the use of many different materials, such as an extra layer of the laminate used for the base members, a thicker layer of polyethylene fixed thereto by melting or similar.

The invention has been described with reference to a specific embodiment. It is obvious that modifications of the base member can be made without deviation from the inventive concept. Such modifications are obvious to the expert on the basis of the guidance and description given above and in the accompanying drawings and such modifications are intended to fall under the scope of the claims.

We claim:

1. Pallet consisting of at least two elongate base members having upper and lower, surfaces and side surfaces said base members having a number of holes provided laterally through the side surfaces perpendicularly to their elongate length directions, distributed along and closely adjacent the upper surfaces of the base members, through which holes, tubes can be inserted under friction so as to unite the base members to the formation of the pallet, characterized in that: each base member of the said pallet consists of three pressed carton pieces (1,2,3) folded to a rectangular U-section, each piece having a length corresponding to the length of the base member, of which the first (1) and the second (2) U-section carton pieces have a height corresponding substantially to the height of the pallet, whereas the third U-section carton piece (3) has a height dimension of the inner surface of its upright portions of its folded U-section which approximates the diameter of the tubes; of which folded carton pieces, one of the first (1) and the second (2) U-section carton pieces in the assembled base member is disposed in the upright U-form with the back of the U-section downwards, the other of the two U-section carton pieces (1,2) is disposed in the inverted U-form and situated within the said one carton piece (1 or 2) and wherein the said third U-section carton piece (3) is located in the assembled base member in an upright U-form disposed within and uppermost in said other U-section carton pice (1 or 2), the distance between the vertical walls of the carton pieces folded to the rectangular U-form being such that they fit closely to each other and by gluing are tightly fixed to each other at surfaces in contact with each other, the holes for the tubes being located so as to lead through the space enclosed by the third carton piece (3) uppermost in the base member, whereupon the tubes are supported by the horizontal inner surface of the third U-section carton piece (3) and by the horizontal inner surface of the other of said U-section carton pieces (1 or 2).

2. Pallet according to claim 1, characterized in that, in the base members thereof, the first (1) and the second (2) U-section carton pieces, each are provided with pairs of gluing tongue pieces (a) and (b) at the location of each of said recesses (13), which tongues, after folding and gluing to each other, form the upper horizontal surface and the lower horizontal surface in the recesses 13.

3. Pallet according to claim 2, characterized in that its base members' inner lower horizontal surfaces are strengthened with added stiff and strong carton material laminate strips (4), the width of which optionally corresponds to the inner width of the base members and which run along the whole length of the base members and below the gluing tongues (1*a, b* or 2*a, b*) present at the lower end of the recesses for forks.

4. Pallet according to claim 2, characterized in that the three U-section carton pieces (1–3) in the base members thereof are pressed from a web material selected from polyethylene-coated carton, folding carton or solid carton.

5. Pallet according to claim 4, characterized in that the web material for the base members has a thickness in the range 0.2–1.0 mms., especially 0.3–0.5 mms.

6. Pallet according to claim 4, characterized in that the three U-section carton pieces (1–3) and the strips (4) in the base members are pressed from a laminate of such web materials, said laminate comprising from 2–8 layers of the web material glued to each other.

7. Pallet according to claim 1, characterized in that a glue is used in the base members so that the three carton pieces (1–3) in the base members have been fixed to each other and the strips (4) have been attached with said glue and said glue is a thermoplastic emulsion glue.

8. Pallet according to claim 1, characterized in that the outer ends of the base members therein have been closed with at least one glue tongue (8).

9. Pallet according to claim 1, characterized in that the outer ends of the base members therein have been diagonal-strengthened with inserted bodies (10), suitably of the same material as the base member.

10. Pallet according to claim 6, characterized in that the said tubes are made from said web material, which when used for the tubes comprises 8–12 laminate layers, which after cutting are folded and glued to an essentially rectangular form.

11. Pallet according to claim 1, wherein said first U-section carton piece (1) is said one U-section carton piece and said second U-section carbon piece (2) is said other carton piece and said third U-section carton piece (3) is located within and uppermost in the second U-section carton piece (2).

12. Pallet according to claim 1, wherein said second U-section carton piece (2) is said one U-section carton piece and said first U-section carton piece (1) is said other carton piece and said third U-section carton piece (3) is located within and uppermost in the first U-section carton piece (1).

13. Pallet as defined in claim 1, wherein said side surfaces of each base member are shaped to provide through passage recesses, having upper and lower surfaces, in the lower portions of said base members for enabling passage of the forks of a fork lift truck through the base members of a pallet.

14. Pallet according to claim 7 wherein said emulsion glue includes the addition of a chelate-former.

15. Pallet as defined in claim 9, wherein said inserted bodies (10) are formed as standing cylinders with vertical axes, made from the same material as the U-section carton pieces.

16. Pallet as defined in claim 9, wherein said inserted bodies are formed as diagonal cross members made from pieces of the same material as the U-section carton pieces.

17. Pallet as defined in claim 10 wherein said tubes are folded and glued to an essentially triangular form.

* * * * *

UNITED STATES PATENT AND TRADEMARK OFFICE

CERTIFICATE OF CORRECTION

PATENT NO. : 4,802,421

DATED : February 7, 1989

INVENTOR(S) : FRED ATTERBY et al.

It is certified that error appears in the above-identified patent and that said Letters Patent is hereby corrected as shown below:

Column 1, line 56, "eight" should be --weight--.

, line 65, "pieces" should be --piece--.

Column 2, line 16, "alternatively" should be --. Alternatively--.

IN THE CLAIMS: (Claim 2)

Column 5, line 48, change "1" to --13--.

Signed and Sealed this

Nineteenth Day of September, 1989

*Attest:*

*Attesting Officer*

DONALD J. QUIGG

*Commissioner of Patents and Trademarks*